US008360566B2

(12) United States Patent
Uptergrove

(10) Patent No.: US 8,360,566 B2
(45) Date of Patent: Jan. 29, 2013

(54) METHOD FOR PRINTING

(75) Inventor: Ronald L. Uptergrove, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 87 days.

(21) Appl. No.: 12/421,439

(22) Filed: Apr. 9, 2009

(65) Prior Publication Data

US 2010/0259575 A1 Oct. 14, 2010

(51) Int. Cl.
*B41J 2/175* (2006.01)

(52) U.S. Cl. ..... 347/89; 347/6; 347/85

(58) Field of Classification Search ..... 347/6, 7, 347/85, 89

See application file for complete search history.

(56) References Cited

U.S. PATENT DOCUMENTS 3,417,175 A 12/1968 Brown et al.
3,490,363 A 1/1970 Derrickson
3,999,190 A 12/1976 Brown et al.
4,067,020 A * 1/1978 Arway ..... 347/7
4,519,310 A 5/1985 Shimizu et al.
4,734,711 A 3/1988 Piatt et al.
5,011,862 A 4/1991 Melber et al.
5,182,571 A 1/1993 Creagh et al.
5,418,557 A * 5/1995 Pullen ..... 347/7
5,459,497 A * 10/1995 Manning et al. ..... 347/6
5,753,325 A 5/1998 McDaniel et al.
5,858,514 A 1/1999 Bowers
5,984,456 A 11/1999 Bern
6,002,844 A 12/1999 Kishida et al.
6,082,563 A 7/2000 Kohn et al.
6,135,654 A 10/2000 Jennel
6,196,668 B1 * 3/2001 Bode ..... 347/85
6,281,916 B1 * 8/2001 VanSteenkiste ..... 347/85
6,343,857 B1 * 2/2002 Cowger ..... 347/89
6,406,115 B2 6/2002 Mantell et al.
6,409,294 B1 6/2002 Zimmermann et al.
6,460,991 B1 10/2002 Temple et al.
6,497,471 B1 12/2002 Gargir
6,513,435 B2 2/2003 Detzner
6,682,191 B2 1/2004 Temple et al.
6,706,342 B2 3/2004 Kong et al.
6,746,093 B2 6/2004 Martinez
6,769,357 B1 8/2004 Finan
6,883,905 B2 * 4/2005 Kimura et al. ..... 347/85
7,104,637 B1 * 9/2006 Van Steenkiste ..... 347/85
7,128,406 B2 10/2006 Dixon et al.
(Continued)

FOREIGN PATENT DOCUMENTS

WO WO 03/002349 A2 1/2003

OTHER PUBLICATIONS

International Searching Authority/US, International Search Report and Written Opinion in counterpart International application No. PCT/US10/30382, mailed Jun. 15, 2010.

*Primary Examiner* — Julian Huffman
*Assistant Examiner* — Sharon A Polk
(74) *Attorney, Agent, or Firm* — Dykema Gossett PLLC

(57) ABSTRACT

A method of printing including providing an ink delivery system including a print head in fluid communication between a first tank and a second tank; and providing a pressure differential across the print head to cause ink to flow from the print head. With embodiments of the method, ink can be controllably dispensed from the print head at substantially the same velocity irrespective of the orientation of the print head with respect to the direction of the force of gravity.

17 Claims, 4 Drawing Sheets

U.S. PATENT DOCUMENTS

| | | | | |
|---|---|---|---|---|
| 7,163,283 | B2 * | 1/2007 | Loyd et al. | 347/85 |
| 7,182,418 | B2 | 2/2007 | Harvey et al. | |
| 7,210,771 | B2 | 5/2007 | Neese et al. | |
| 7,311,389 | B1 | 12/2007 | Pidgeon | |
| 7,399,075 | B2 * | 7/2008 | Nomura et al. | 347/89 |
| 7,517,032 | B2 * | 4/2009 | Nottelman et al. | 347/5 |
| 7,648,224 | B2 * | 1/2010 | Sasa et al. | 347/36 |
| 7,669,531 | B2 | 3/2010 | Baker et al. | |
| 7,850,290 | B2 * | 12/2010 | Nitta et al. | 347/85 |
| 2002/0097280 | A1 | 7/2002 | Loper et al. | |
| 2005/0211371 | A1 | 9/2005 | Hirst et al. | |
| 2006/0250464 | A1 | 11/2006 | Sheinman | |
| 2007/0052740 | A1 | 3/2007 | Guhse et al. | |
| 2008/0143802 | A1 | 6/2008 | Morgan et al. | |
| 2009/0002408 | A1 * | 1/2009 | Azami et al. | 347/6 |
| 2009/0040249 | A1 * | 2/2009 | Wouters et al. | 347/7 |
| 2009/0160901 | A1 | 6/2009 | Achhammer | |
| 2009/0169719 | A1 * | 7/2009 | Orr | 427/8 |
| 2010/0289857 | A1 * | 11/2010 | Bennett | 347/89 |

* cited by examiner

METHOD FOR PRINTING

TECHNICAL FIELD

The present invention relates to ink delivery apparatus and systems, including ink delivery apparatus and systems that are suitable for use with flow-through print heads.

BACKGROUND

Printing systems having various forms of ink delivery systems are found in the art. However, a number of conventional systems that supply larger quantities of ink—for example to printers—are most commonly passive—i.e., employing gravity feed, capillary feed siphons, and the like. Many such systems are constrained by the effects of gravity and/or require the maintenance of specific constant heights between components of the system. Moreover, many conventional ink delivery systems either cannot deliver ink to print sideways (or directions significantly from vertical), or they cannot do so well.

SUMMARY

An ink delivery system includes a first tank including a fill sensor; a second tank including a fill sensor; a pump configured to pump ink from the first tank to the second tank; a third tank including a fill sensor; a print head in fluid communication with the second tank and the third tank. In an embodiment, the third tank is in fluid communication with the first tank and may be configured to provide a closed loop system, the second tank is in fluid communication with the third tank, and a pressure differential across the print head causes ink to flow through the print head. For some embodiments, pumps may be provided to control pressure differentials and print heads may print at one or more angles.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
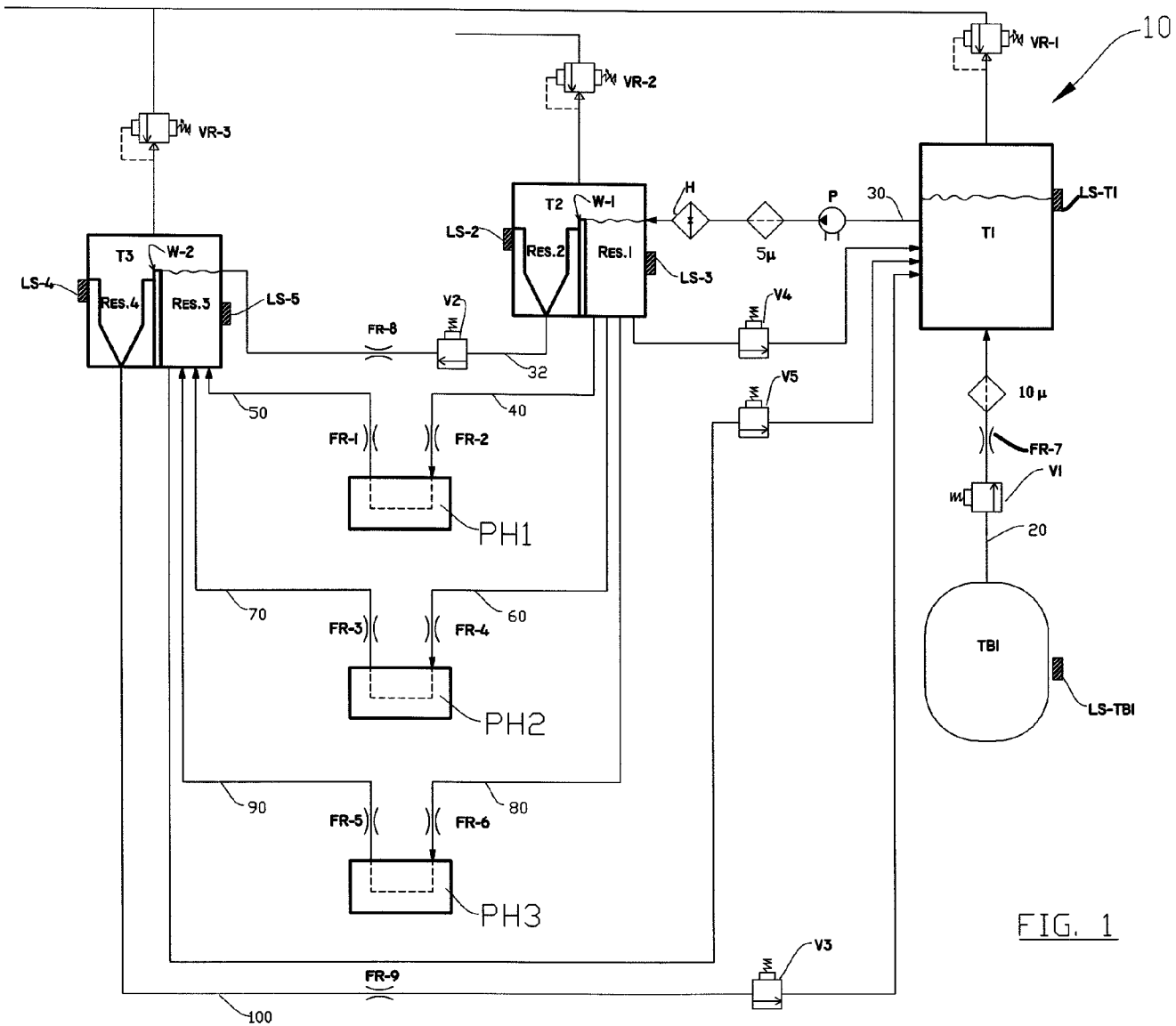
FIG. 1 is a schematic illustration of an ink delivery system in accordance with an embodiment of the invention.

FIG. 1 generally illustrates an ink delivery system 10 in accordance with an embodiment of the invention. Ink can be supplied to the system 10 from a source, e.g., bulk ink tank TBI, which may include a level sensor LS-TBI. In an embodiment, the bulk ink tank TBI may be open to atmospheric pressure, and the bulk ink tank TBI is in fluid communication with a first tank T1, which may also include a level sensor LS-T1. As generally illustrated, the bulk ink tank TBI and the first tank T1 may be connected by a conduit or passageway 20, and the conduit or passageway 20 may include a make-up fill valve V1 and a flow restrictor FR-7 for controlling flow between the bulk ink tank TBI and the first tank T1. As used herein, the term "conduit" or "passageway" may comprise various forms of rigid or flexible paths, and may comprise, for example and without limitation, a hose, tube, supply line, or other conventional means for supplying ink from one component of the system to another.

Pressure in first tank T1 may be regulated by a regulator VR-1, which may include a valve and can control or regulate the pressure in first tank T1 to provide a vacuum. For example, without limitation, regulator VR-1 may regulate the pressure in first tank T1 to approximately −350 mbar. Make-up fill valve V1 may open to permit the vacuum associated with first tank T1 to draw ink from the bulk ink tank TBI. Ink can be permitted to flow from the bulk ink tank TBI into the first tank T1 until a specified fill level is reached—which may be signaled, for example, by a level sensor LS-T1. Once a specified or desired fill level is sensed or otherwise detected, make-up fill valve V1 can be closed. Make-up fill valve V1 can again be opened as need so that the fill level of first tank T1 can be maintained continuously. It is noted that several sensor-and-valve feedback control loops are envisioned in connection with the system and the implementation of such controls will be readily understood by those of skill in the art.

Figure 1A:
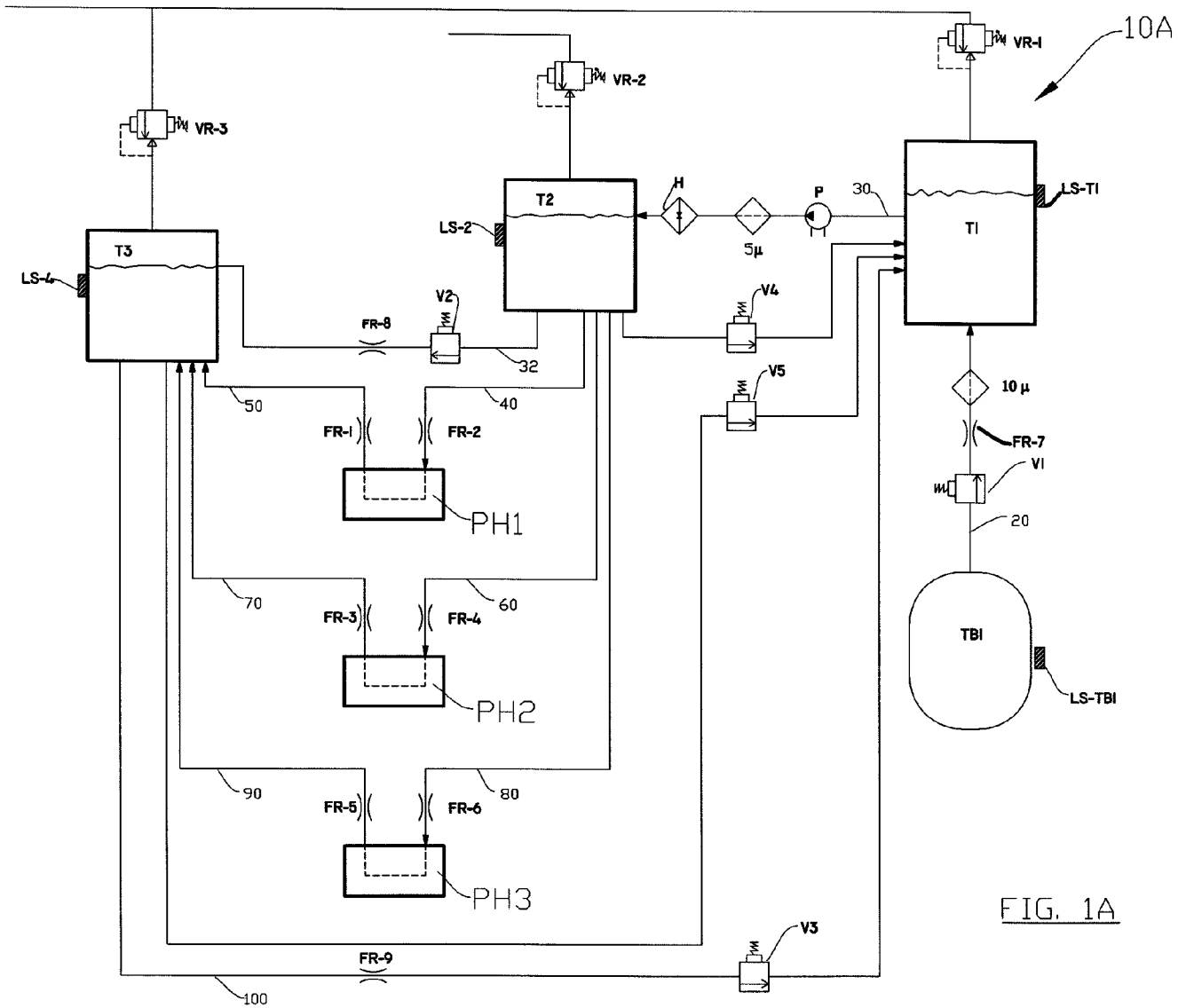
FIG. 1A is a schematic illustration of an ink delivery system in accordance with another embodiment of the invention.

As generally illustrated, system 10 is further shown to include a second tank T2 and a third tank T3. It is noted that the term "tank," as used herein, is intended to be construed broadly to include various types of ink-retaining tanks and/or various forms of fluid chambers. Further, each tank T2, T3 may additionally include reservoirs that are in communication with each other and are separated, at least in part, by a weir or overflow control barrier (hereinafter referred to as a "weir"). Such weirs can be configured to serve, at least in part, as a means to provide a hydraulic dampening effect to the system. For instance, as generally illustrated, second tank T2 may include a first reservoir RES.1 and a second (secondary) reservoir RES.2, the first and second reservoirs being separated by a weir W-1. In a similar manner, third tank T3 may include a third reservoir RES.3 and a fourth (secondary) reservoir RES.4, the third and fourth reservoirs being separated by a weir W-2. Additionally, each of the aforementioned reservoirs, RES.1, RES.2, RES.3, and RES.4, may include a corresponding level sensor—generally illustrated in FIG. 1 as LS-3, LS-2, LS-5, and LS-4, respectively. FIG. 1A generally illustrates an embodiment of a system similar to that shown in FIG. 1. However, the tanks included in system 10A in FIG. 1 do not include (or require) the reservoirs or weirs included in system 10 of FIG. 1. Moreover, as generally illustrated, with the exclusion of the separate reservoirs, system 10A may be modified such that only one fill measurement is detected in connection with of tanks T2 and T3. This can be accomplished, for example and without limitation, by including a single sensor in connection with each tank—i.e., sensor LS-2 (tank T2) and sensor LS-4 (tank T3).

As illustrated in Figures, first tank T1 and second tank T2 may be in fluid communication—for example via a conduit or passageway 30. In an embodiment, ink may be pumped from first tank T1 to T2 (or to first reservoir RES.1 of second tank T2) via a pump P, such as a fill pump. If desired, the ink may additionally be pumped through or past a heater H, which can be activated to heat and/or maintain the ink at a desired or designated operating temperature prior to entering the second tank T2. Further, second tank T2 may be maintained at a positive pressure by a regulator VR-2. For example, without limitation, second tank T2 may be maintained at a pressure of approximately +30 mbar.

Ink provided to the second tank T2 may flow into and fill first reservoir RES.1. Once first reservoir RES.1 is filled to a certain level, ink will flow over weir W-1 into second reservoir RES.2. In an embodiment, the flow of ink into second tank T2 may be maintained at a sufficient volume so that first reservoir RES.1 is consistently full (e.g., to the top of the weir) and ink may be overflowing into the second reservoir RES.2. As the fill level of ink in the second reservoir RES.2 rises, and level sensor LS-2 detects a full or designated fill level, a valve V2 may be opened to permit ink to flow (e.g., via conduit or passageway 32) from second tank T2 into third tank T3 (i.e., into third reservoir RES.3 of the third tank T3). It is noted that the third tank T3 may be maintained at a vacuum by a regulator VR-3 to facilitate the described ink flow (i.e., from T2 to T3).

As ink flows into the third tank T3, the third tank T3 may operate in a similar manner as previously discussed in connection with ink flow into second tank T2. That is, third tank T3 may be configured so that by having a sufficient volume flow of ink to maintain the third reservoir RES.3 in a filled and/or overflowing into fourth reservoir RES.4. As the fill level of ink in the third reservoir RES.3 rises, and level sensor LS-4 detects a full or designated fill level, a valve V3 may be opened to permit ink to flow from the third tank T3 back to the first tank T1. With such an embodiment, system 10 can be configured to provide a continuous flow loop in which ink is supplied from first tank T1 and the portion that is not printed along the route of the system is returned to first tank T1. As shown in the illustrated embodiment, the system 10 may additionally include drain valves V4 and V5 that are in fluid communication between first reservoir RES.1 and the first tank T1, and between the third reservoir RES.3 and the first tank T1, respectively.

As generally illustrated in the Figure, the system 10 may include one or more print heads—e.g., PH1, PH2, and PH3—in fluid communication with the first reservoir RES.1 of second tank T2 and the third reservoir RES.3 of tank T3. In an embodiment, the print head or heads used in connection with the system can comprise various types of flow-through print heads. Further, with some embodiments, the print head/system may comprise a digital drop-on-demand ink jet or ink jet system. However, the invention is not limited to a specific type of print head, and various other types and forms of print heads may be used.

Without limitation, in the illustrated embodiment, conduits or passageways 40, 60, and 80, flow from the first reservoir RES.1 into print heads PH1, PH2, and PH3, respectively. Similarly, in the illustrated embodiment, conduits or passageways 50, 70, 90, flow from print heads PH1, PH2, and PH3 to the third reservoir RES.3. In an embodiment of the system 10, one or more of the conduits or passageways associated with the one or more print heads may include a flow restrictor. In some embodiments, such flow restrictors may comprise various forms of restriction devices or apparatus used to provide fluid restrictions for tubes or passageways. By way of example, as generally illustrated, each of the conduits or passageways leading into the print heads (e.g., 40, 60, 80) and each of the conduits or passageways leaving the print heads (e.g., 50, 70, 90) may include a flow restrictor—see, e.g., flow restrictors designated FR-2 and FR-1 (PH1), FR-4 and FR-3 (PH2), and FR-5 and FR-4 (PH3). Further, in an embodiment, a flow restrictor FR-8 may be included and used to balance/control flow between the second tank T2 and the third tank T3, and a flow restrictor FR-9 may be included and used to balance/control flow between the third tank T3 and the first tank T1 (e.g., example along illustrated conduit or passageway 100). However, it is noted that in other embodiments, the conduits or passageways themselves may be, i.e., serve or function, as the flow restrictor. That is, rather than requiring the inclusion of a separate device or apparatus, one or more of the conduits or passageways may be configured (e.g., may have a given internal diameter) so that, in the context of the system and the associated fill/pressure regulation, the conduit or passageway itself is, or serves, as a flow restrictor. For example, as generally shown in FIG. 1, where conduit or passageway 32 is illustrated in connection with flow restrictor FR-8, for some embodiments, rather than FR-8 signifying the inclusion of a separate or additional device to provide flow restriction, the configuration of the conduit or passageway itself (e.g., 32) may also be or serve as the flow restrictor (e.g., FR-8).

In an embodiment of the system 10, regulators VR-3 and VR-2, which may be vacuum regulators associated with the second and third tanks T2, T3, respectively, can be maintained at specific or controlled values to cause or impart a pressure differential across the print heads. The pressure differential can be used to control the flow of ink through the respective print heads. Moreover, the flow rate of ink through an individual print head can be, at least in part, controlled by the associated flow restrictors. The flow restrictors along with the pressure differential set/control the flow volume of ink as well as the required meniscus pressures associated with the print head-and-ink combination.

A system 10 according to embodiments of the invention can be configured to permit the print heads to be at any orientation relative to gravity. That is, given the flow provisions associated with the system 10, which are not dependent upon gravity feed and height differentials between tanks and print heads, the system 10 can provide one or more print heads that are configured to print at various (non-vertical/downward) angles with respect to an intended target object. As previously disclosed, such flow provisions associated with the system and the print heads can include, for example, pressure/vacuum regulating devices, engineered flow restrictions, and the provision of a closed loop in system that is not open to atmosphere while in operation. Moreover, systems that are configured in accordance with the teachings of the present invention can, as the print heads are oriented, regulate and control associated pressure to maintain a constant meniscus pressure at the print heads.

Figure 2:
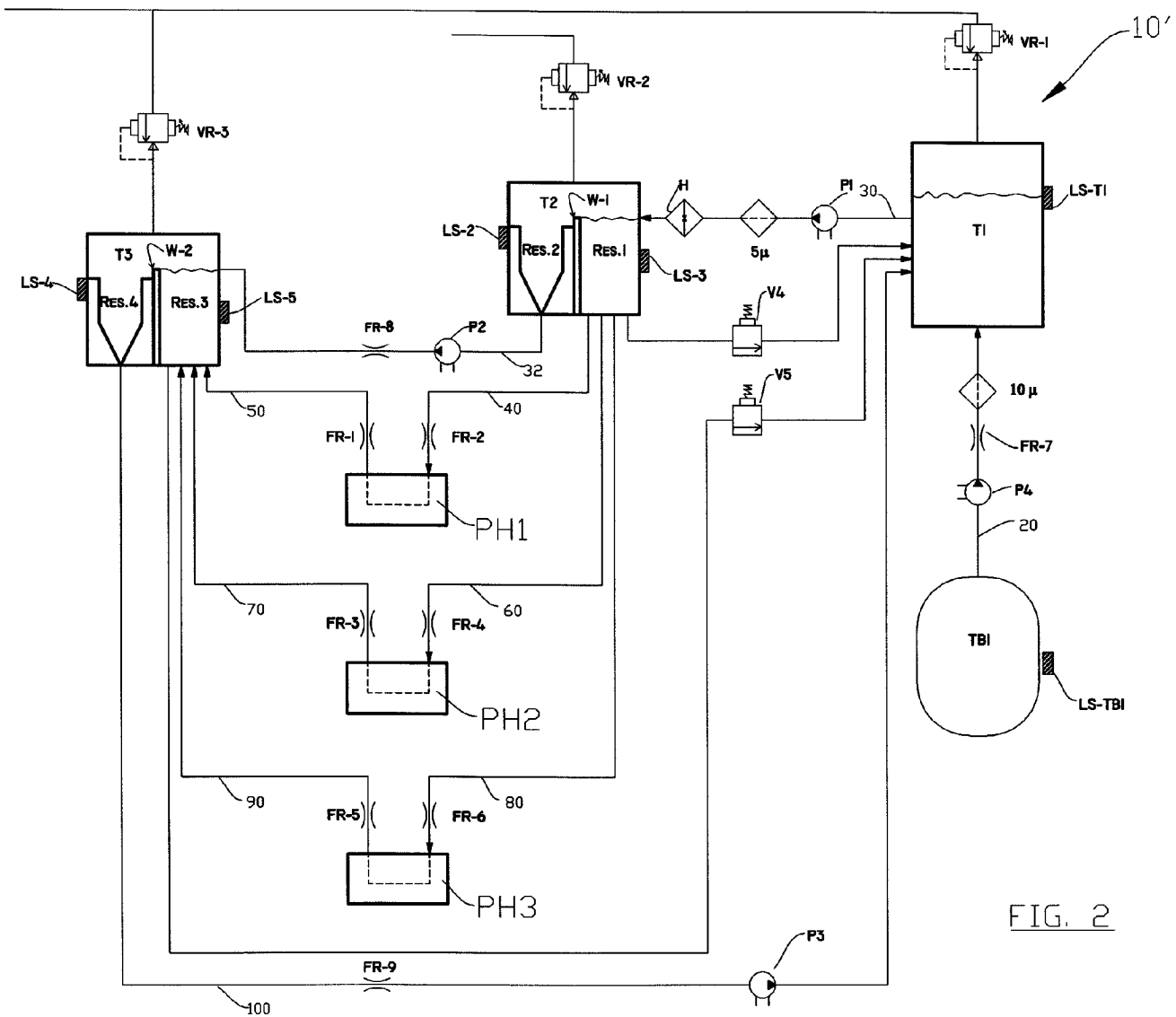
FIG. 2 is a schematic illustration of an ink delivery system in accordance with still another embodiment of the invention, the system including a plurality of pumps.

FIG. 2 generally illustrates an ink delivery system 10' in accordance with another embodiment of the invention. For ease of reference, similar element numbers and designations are used to identify similar components to those discussed in connection with FIG. 1. The system 10' illustrated in FIG. 2 is similar to that shown in FIG. 1; however, certain valves have been replaced by pumps. For example, valves V1, V2, and V3 (illustrated in FIG. 1) have been replaced with pumps $P_4$, $P_2$, and $P_3$, respectively. With this embodiment of the system 10', the flow restrictors maintain various pressure within the tanks and the plurality of pumps serve, at least in part, to maintain level control.

For instance, with respect to the illustrated embodiment of the system 10', pump $P_1$—which supplies ink from tank T1—may be run at a substantially constant rate. The rate may be faster than the rate that the associated print heads draw ink. Pump $P_2$—which supplies ink from tank T2 (RES.2) to tank T3 (RES.3)—may be run at a lower pump speed/flow than pump $P_1$. Ink then may be drawn from T2 at a slower rate than ink is delivered to T1. Consequently, the level in tank T2 rises. If pump $P_2$ is run at a speed/flow that is faster than pump $P_1$, then the level of ink within tank T2 will decrease. When pump $P_2$ is again slowed down, ink will again fill tank T2. Consequently, the ink levels associated with tank T2 may be controlled by changing the rate/flow associated with the running of pump $P_2$. In a similar manner the level associated with Tank T3 may be controlled, at least in part, by controlling the running of pump $P_3$. With such a system configuration, the various pumps may be run to maintain desired ink levels in the associated tanks. The use of pumps can provide smooth rate/flow transitions, as the pumps may be constantly moving and their relative rates/flows may be controlled to provide desire fill levels fairly dynamically. As such the system may be controlled by speed/flow changes associated with the pumps rather than requiring the opening/closing of components in the flow path.

Figure 3:
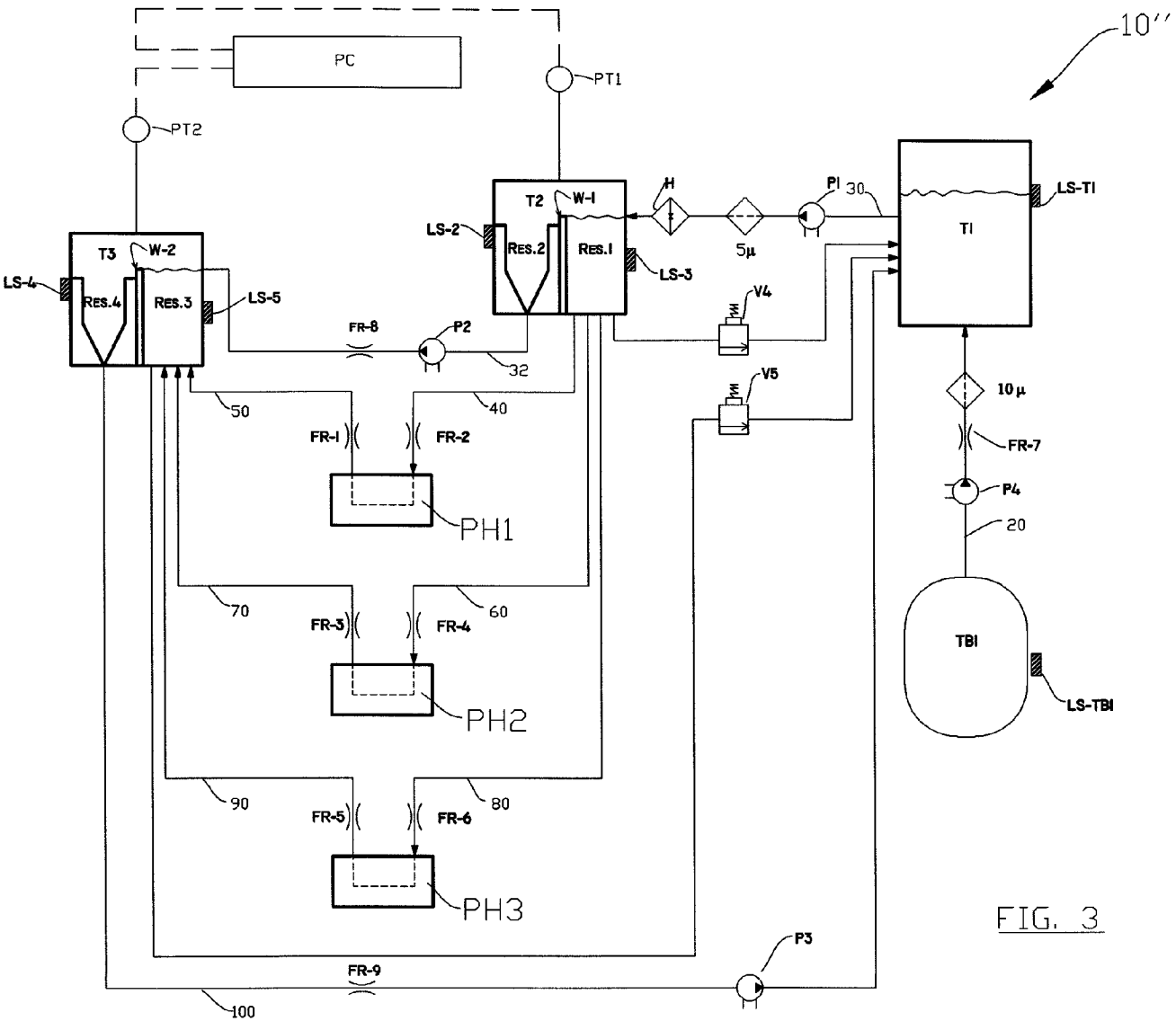
FIG. 3 is a schematic illustration of an ink delivery system in accordance with yet another embodiment of the invention, the system including a plurality of pumps.

FIG. 3 generally illustrates an ink delivery system 10" in accordance with another embodiment of the invention. For ease of reference, similar element numbers and designations are again used to identify similar components to those discussed in connection with the embodiments illustrated in FIGS. 1 and 2. System 10" illustrated in FIG. 3 is a "closed" system but includes certain similarities to the system 10' shown in FIG. 2, and also does not require the inclusion of valves, such as valves V1, V2, and V3, or even tanks with reservoirs, as generally shown in FIG. 1. Moreover, as with system 10' shown in FIG. 2, the embodiment of system 10" shown in FIG. 3 includes a plurality of pumps e.g., pumps $P_1$, $P_2$, $P_3$, and $P_4$. Additionally, as generally illustrated, pump controller PC is provided between tanks T2 and T3. Pump controller PC may also be in operative connection with one or more pressure transducers (e.g., PT-1 and PT-2), as generally illustrated.

In connection with the embodiment of the system 10", vacuum regulators are not required. That is, the printing associated with the embodiment of the system may be controlled based on flow control rather than tank fill level control. With reference to the illustrated embodiment, pump $P_4$ is not associated with a "pulled vacuum." Rather, when a need for ink in Tank T1 is determined or sensed, pump $P_4$ can be configured to provide a supply of ink. Also, as generally illustrated, a pump $P_2$ may also be provided between tank T2 and tank T3, and pump $P_3$ may be provided between tank T3 and tank T1. Also, as previously noted, a pump controller PC may be provided between tanks T2 and T3. With system 10" pressure sensors associated with tanks T2 and T3 provide feedback to pump controller PC—which, in turn, may be used to provide control instructions (e.g., pump speed control) to pumps $P_1$, $P_2$, and/or $P_3$.

Coordinated operation of the pumps can provide system 10" with desired pressures and ink delivery for printing. As ink is pumped to a tank (e.g., tank T2), the pressure in the tank will increase. At a given pressure level, a subsequent pump in the system (e.g., $P_2$) may be turned on/up to evacuate the tank. As such, the speed/flow associated with an associated pumps (e.g., $P_2$ and $P_1$) may be controlled/regulated to maintain a positive pressure level and/or to maintain a desired pressure level in a given tank. By way of example, with reference to the embodiment illustrated in FIG. 3, if a positive pressure is provided in tank T2 and a negative pressure is provided in tank T3, ink will flow through the associated print heads that are in operative communication therebetween. As the pressure associated with tank T3 increases, pump $P_3$ may, for example, be run faster to maintain a negative pressure with respect to tank T3 (and provide for continued flow of ink from tank T2 to tank T3 through the print heads (e.g., PH1, PH2, and PH3).

By applying the teachings associated with the foregoing embodiments of the ink delivery systems, the associated print heads can be oriented in any way with respect to gravity and still deliver a desired amount of ink through the print heads. Consequently, the present invention permits, among other things, the print heads to be able to print in any given direction (including those opposing gravity) to print in any given orientation without modifying the associated ink delivery system. Moreover, such changes in print head orientations can be handled dynamically, i.e., without requiring the stationary periods between printing. By way of example, without limitation, embodiments of the invention may be very useful in connection with printing, e.g., digitally printing, on the surfaces of various articles, such as printing labels and/or other matter on various forms of plastic containers.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed is:

1. A method for printing comprising:

providing an ink delivery system including a first tank including a fill sensor; a second tank including a fill sensor, wherein the first tank is in fluid communication with the second tank; a pump configured to pump ink supplied from the first tank to the second tank; a third tank including a fill sensor; and a plurality of flow-through print heads, each of the plurality of print heads in direct fluid communication with each of the second tank and the third tank by conduit or passageway, wherein the third tank is in fluid communication with the first tank, the second tank is in fluid communication with the third tank; and providing a pressure differential across the plurality of print heads to cause unjetted ink to flow through the print heads and into the third tank;

wherein the flow of ink is controlled or adjusted to maintain a substantially constant meniscus pressure at the plurality of print heads.

2. The method of claim 1, including:

providing an article to be printed; and printing on a surface of the article.

3. The method of claim 1, wherein:

the second tank includes a first reservoir, a second reservoir, and a weir between the first reservoir and the second reservoir; the third tank includes a third reservoir, a fourth reservoir, and a weir between the third reservoir and the fourth reservoir; and wherein the first tank is in fluid communication with the first reservoir; the second reservoir is in fluid communication with the third reservoir; the fourth reservoir is in fluid communication with the first tank; and the print head is in fluid communication with the first reservoir and the third reservoir.

4. The method of claim 3, including measuring the fill level of the second reservoir; and measuring the fill level of the fourth reservoir.

5. The method of claim 1, including:

providing a regulator in communication with the first tank;

controlling or regulating the pressure in first tank to provide a vacuum.

6. The method of claim 1, including permitting ink to flow from a bulk ink tank to the first ink tank until a fill level is detected by the fill sensor of the first tank.

7. The method of claim 1, including heating ink flowing between the first tank and the second tank.

8. The method of claim 1, including regulating the pressure in the second tank to provide or maintain a positive pressure in the second tank; and regulating the pressure in the third tank to provide or maintain a pressure in the third tank, such that a pressure differential is provided across the plurality of print heads.

9. The method of claim 1, including controlling or adjusting the flow rate of ink through the print head as the print heads are oriented.

10. The method of claim 1, including adjusting the pressure differential and the flow rate of ink to set or control flow volume of ink and maintain a constant meniscus pressure at the print heads.

11. The method of claim 1, including adjusting the orientation of one or more of the plurality of print heads to print at one or more angles.

12. The method of claim 1, including rotating one or more of the plurality of print heads about a two-dimensional plane.

13. The method of claim 1, including translating or rotating one or more of the plurality of print heads based upon the size and shape of an object to be printed upon.

14. The method of claim 1, including:

providing a first pump to pump ink supplied from the first tank to the second tank;

providing a second pump to pump ink from the second tank to the third tank;

operating the pumps to create the pressure differential across the print heads.

15. The method of claim 1, including providing a pump controller in communication with the second tank and the third tank and controlling the pressure differential across at least one print head.

16. The method of claim 1, including orienting one or more of the plurality of print heads during printing without requiring a stationary period.

17. The method of claim 1, wherein the system is configured to provide a closed loop system that is not open to atmosphere while in operation.

* * * * *